US008104655B2

(12) United States Patent
Zhang

(10) Patent No.: US 8,104,655 B2
(45) Date of Patent: Jan. 31, 2012

(54) LAPTOP CARRIER

(75) Inventor: Yu Zhang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 435 days.

(21) Appl. No.: 12/503,847

(22) Filed: Jul. 16, 2009

(65) Prior Publication Data

US 2010/0038393 A1 Feb. 18, 2010

(30) Foreign Application Priority Data

Aug. 13, 2008 (CN) ..... 2008 1 0303733

(51) Int. Cl.
*A45F 5/00* (2006.01)

(52) U.S. Cl. ..... 224/623; 224/578; 224/581; 224/614; 224/257; 224/930

(58) Field of Classification Search ..... 224/581, 224/578, 197, 199, 600, 607, 608, 614, 257, 224/258, 623, 265, 270, 930
See application file for complete search history.

(56) References Cited

U.S. PATENT DOCUMENTS

| | | | | | |
|---|---|---|---|---|---|
| 4,763,763 | A * | 8/1988 | Sadow | 190/115 |
| 5,415,332 | A * | 5/1995 | Kliot | 224/153 |
| 5,639,004 | A * | 6/1997 | Carlton et al. | 224/579 |
| 5,724,225 | A * | 3/1998 | Hrusoff et al. | 361/679.55 |
| 5,938,096 | A * | 8/1999 | Sauer et al. | 224/625 |
| 6,213,304 | B1 * | 4/2001 | Juliussen | 206/581 |
| 6,349,864 | B1 * | 2/2002 | Lee | 224/270 |
| 6,381,127 | B1 * | 4/2002 | Maddali et al. | 361/679.55 |
| 7,051,910 | B2 * | 5/2006 | Sprague et al. | 224/638 |
| 7,778,026 | B2 * | 8/2010 | Mitchell | 361/679.55 |
| 7,780,049 | B1 * | 8/2010 | Baranoski | 224/250 |

FOREIGN PATENT DOCUMENTS

| | | | |
|---|---|---|---|
| CN | 2722316 | Y | 8/2005 |
| JP | 1996-150010 | A | 6/1996 |

* cited by examiner

*Primary Examiner* — Justin Larson
(74) *Attorney, Agent, or Firm* — Altis Law Group, Inc.

(57) ABSTRACT

A laptop carrier includes a case portion, a strap and a pair of clipping members. The case portion includes a first shell, a hinge, a second shell rotatably connected by the hinge, and a latching member for latching and unlatching the first and the second shells. Two ends of the strap are mounted on two respective opposite sides of the case portion. The pair of clipping members is attached on the strap for interlocking part of the strap and one of the first or second shells of the case portion.

11 Claims, 4 Drawing Sheets

LAPTOP CARRIER

BACKGROUND

1. Technical Field

The disclosure relates to a carrier, and more particularly, to a laptop carrier.

2. Description of Related Art

As compared to conventional desktop computer, notebook or laptop computers appear to offer great portability because of their small size. In use, users can input data with one hand while supporting the laptop with the other hand. However, after an extended period of time, support of the laptop with one hand becomes uncomfortable. Moreover, efficient keyboard entry and other cursor control (e.g., touchpad) require the use of both hands.

Therefore, what is needed is to provide a laptop carrier in which the above problem is eliminated or at least alleviated.

DETAILED DESCRIPTION

Figure 1:
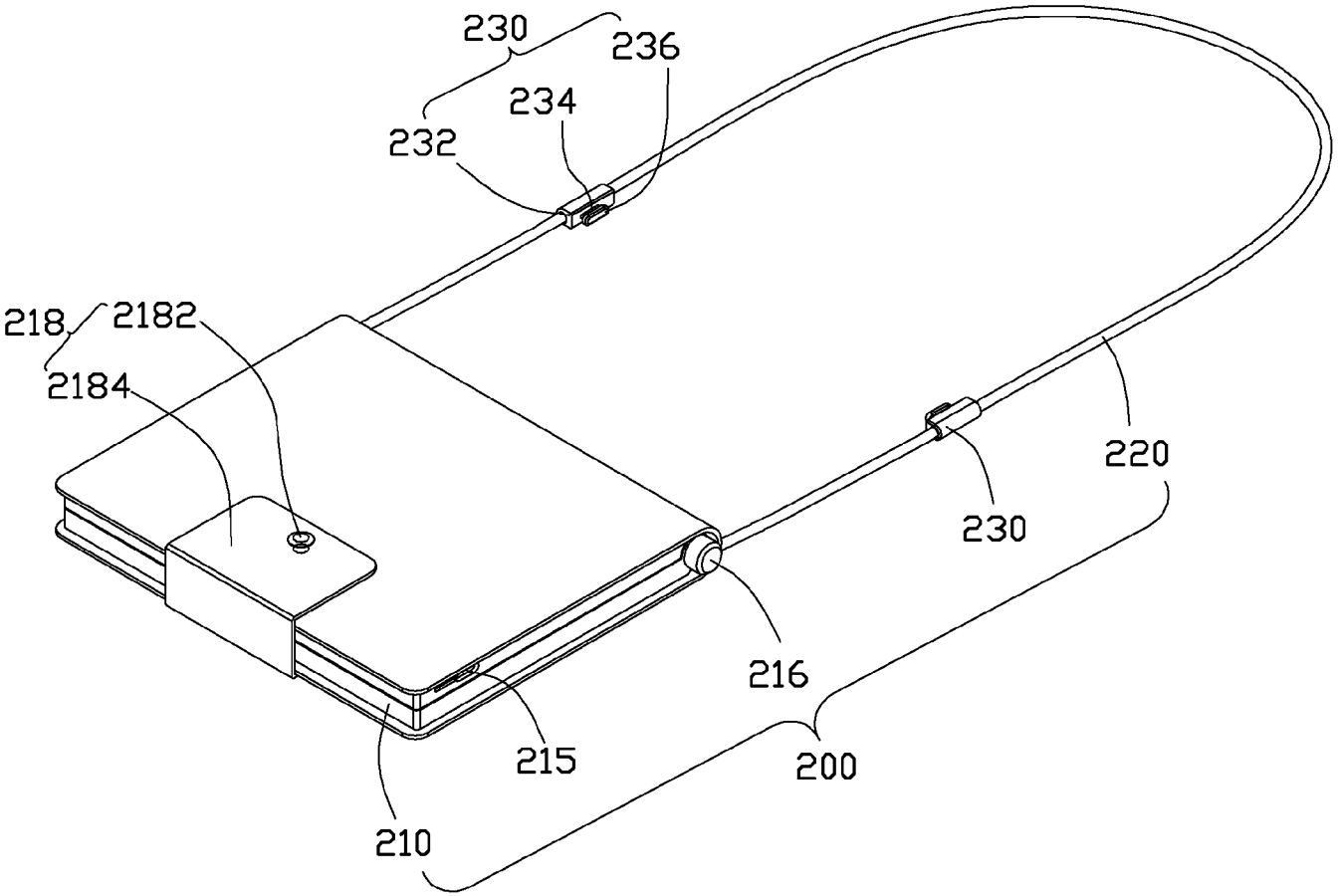
FIG. 1 is an isometric view of a laptop received in a laptop carrier according to an exemplary embodiment.
Figure 2:
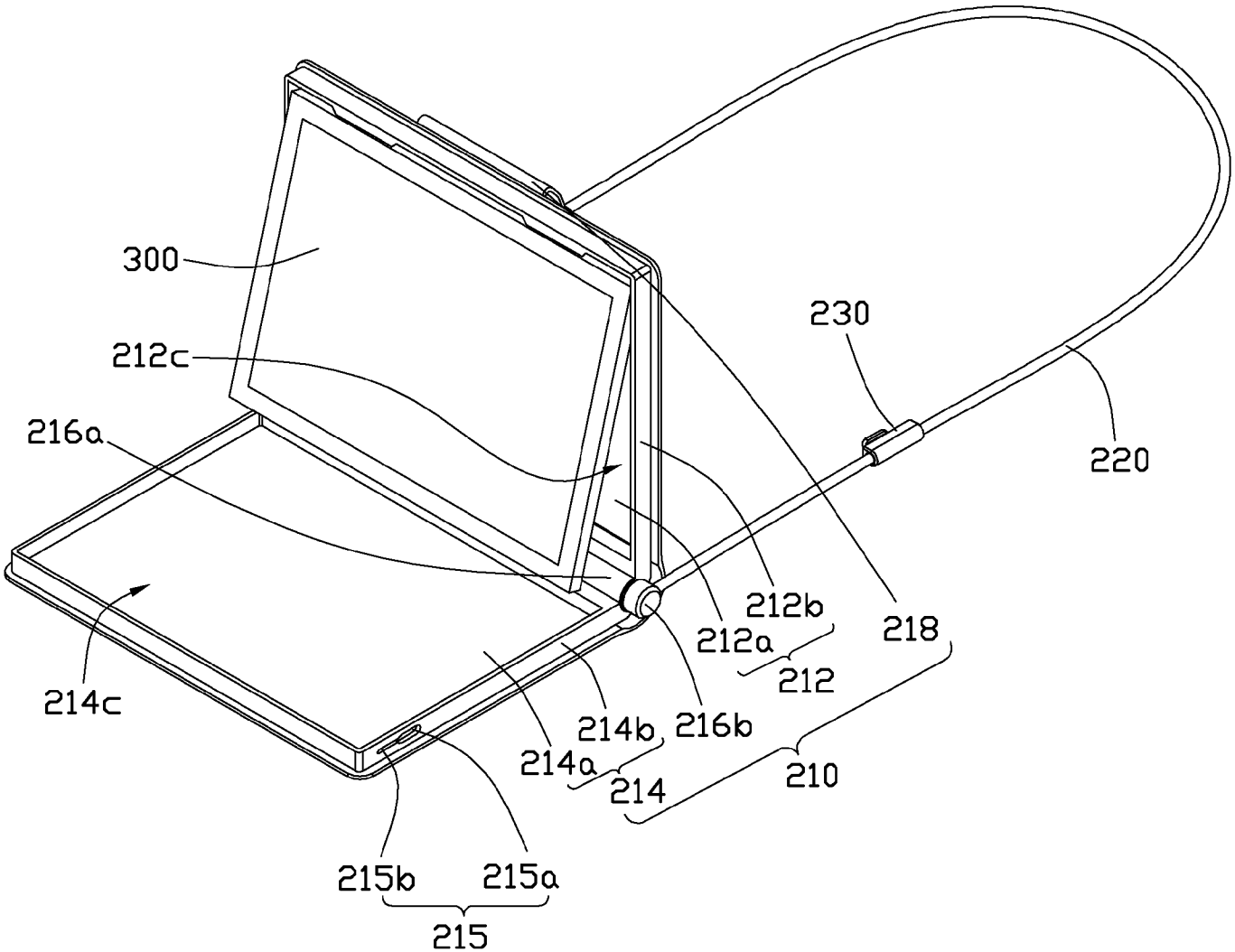
FIG. 2 is another isometric view of FIG. 1, showing the laptop carrier and the laptop at an opened state.

Referring to FIGS. 1 and 2, a laptop carrier 200 and a laptop 300 contained in the laptop carrier 200 are shown.

The laptop carrier 200 includes a case portion 210, a strap 220 and a pair of clipping members 230. The strap 220 has a first end and a second end respectively mounted on opposite sides of the case portion 210. The pair of clipping members 230 is separately attached on the strap 220 for interlocking the strap 220 and a part of the case portion 210.

The case portion 210 includes a first shell 212, a second shell 214, a hinge 216 and a latching member 218. The first shell 212 and the second shell 214 are rotatably connected to each other by the hinge 216. The latching member 218 is configured for latching and unlatching the first and second shells 212, 214.

The first shell 212 is rectangular, and includes a rectangular upper sheet 212*a* and four upper side walls 212*b*. The upper side walls 212*b* perpendicularly extend from a periphery of the upper sheet 212*a*. The upper sheet 212*a* and the upper side walls 212*b* cooperatively define a first compartment 212*c* for receiving an upper portion of the laptop 300. Understandably, the shape of the first compartment 212*c* may be of a form according to the profile of the laptop 300 to be housed in the carrier.

The second shell 214 similar to the first shell 212, includes a lower sheet 214*a* and four lower side walls 214*b* The lower side walls 214*b* perpendicularly extend from a periphery of the lower sheet 214*a*.The lower sheet 214*a* and the lower side walls 214*b* cooperatively define a second compartment 214*c* for receiving a lower portion of the laptop 300. The first and second compartments 212*c*, 214*c* cooperatively receive the laptop 300 entirely. In this embodiment, a pair of opposite lower side walls 214*b* has a pair of slots 215 separately defined on each of them. Each slot 215 includes a wider portion 215*a* and a narrow portion 215*b* communicating with the wider portion 215*a*. Alternatively, the slots 215 may also be formed in the upper side walls 212*b* of the first shell 212 and should not be limited to in the lower side walls 214*b*. The slots 205 are configured for receiving the clipping members 230.

The hinge 216 includes a sleeve 216*a* and a pivot shaft 216*b*. The sleeve 216*a* is attached on an edge of the first shell 212. The pivot shaft 216*b* is attached on the second shell 214 after sleeved in the sleeve 216*a*. An attaching position of pivot shaft 216*b* on the second shell 214 is adjacent to the other pair of the second walls 214*b* without the slot 205. A static friction applied between the sleeve 216*a* and the pivot shaft 216*b* can hold the first shell 212 and the second shell 214 in a relative stable state. When the first shell 212 and the second shell 214 are separated by a certain angle, the hinge 216 can maintain position of the first and second shells 212, 214 relative to each other.

The latching member 218 includes a fastener 2182 and a flap 2184 engaged with the fastener 2182. An end of the flap 2184 is secured to one of the first or second shells 212, 214, and the other end of the flap 2184 is detachably coupled on the other corresponding one of the first or second shells 214, 212 by the fastener 2182. In this embodiment, the fastener 2182 is made of a couple of magnets which are separately secured on the flap 2184 and the first shell 212 correspondingly. Alternatively, the fastener 2182 also may be another form such as a couple of snap buckle according to various demands.

The strap 220 is configured as a suspender for the case portion 210. The strap 220 is engaged with the case portion 210 adjacent to the hinge 216.

The pair of clipping members 230 is configured for interlocking the strap 220 and any one of the first or second shells 212, 214. In this embodiment, the clipping members 230 are separately secured on the strap 220 and capable of inserting into the slots 215 correspondingly. Each clipping member 230 includes a bushing 232, a connecting portion 234 and a plug 236. The bushing 232 is sleeved on the strap 220. The connecting portion 234 protrudes from an outside of the bushing 232 and supports the plug 236 at a distal end. A width of the plug 236 is smaller than that of the wider portion 215*a* of the slot 215, but bigger than that of the narrow portion 215*b* of the slot 215. A width of the connecting portion 234 is smaller than that of narrow portion 215*b* of the slot 215. The clipping members 230 lock the second shell 214 and the strap 220 by sliding the plug 236 into the narrow portion 215*b* of the slot 215 from the wider portion 215*a*. Alternatively, the positions of the clipping members 230 and the slots 215 can be exchanged.

Figure 3:
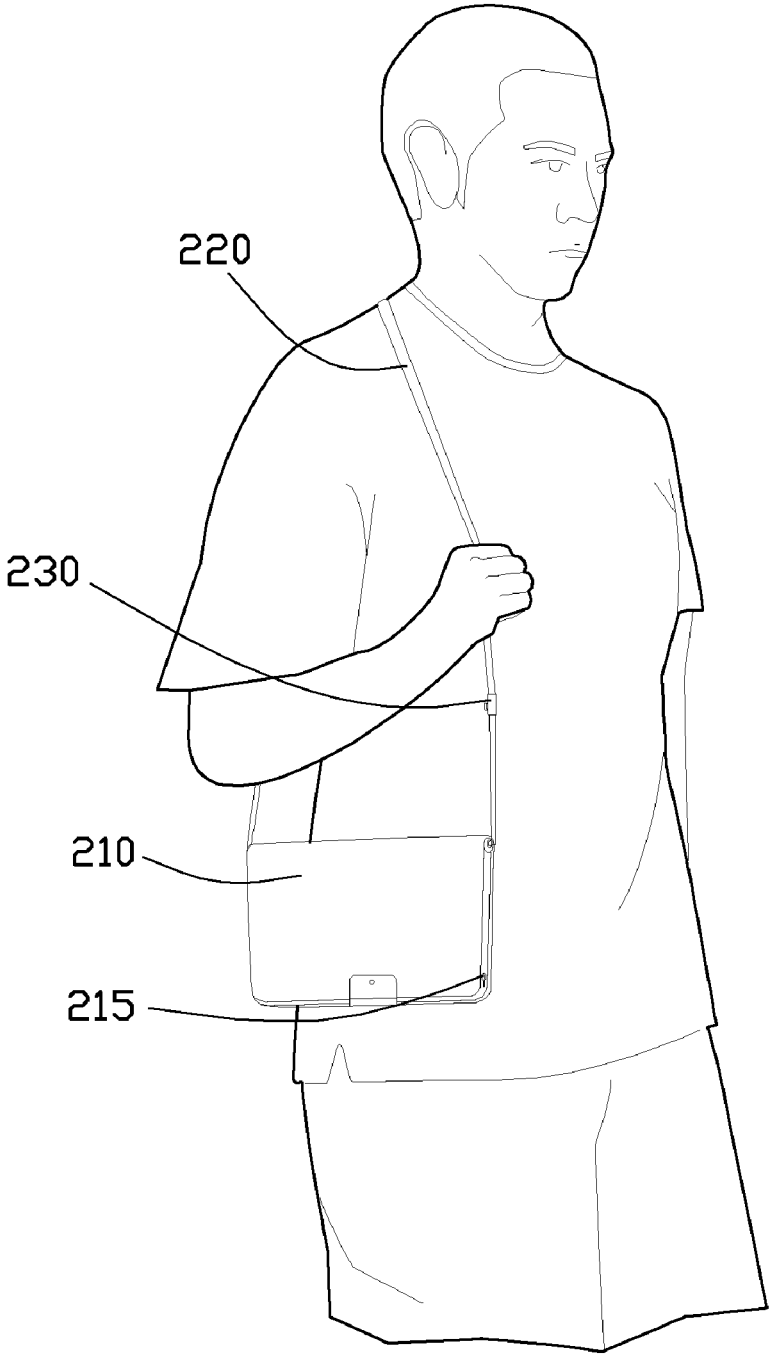
FIG. 3 is a schematic view of the laptop received in the laptop carrier during used.
Figure 4:
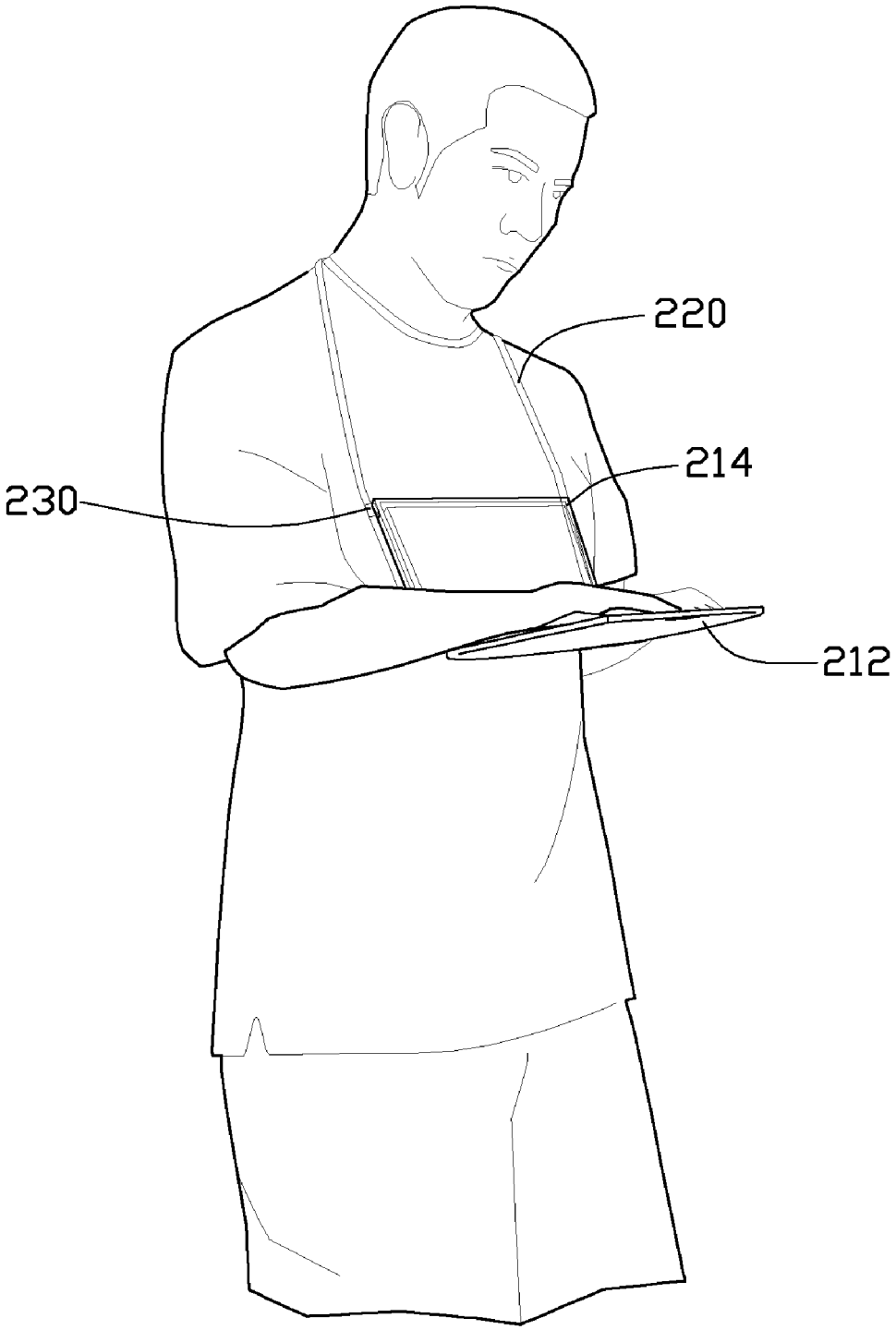
FIG. 4 is similar to FIG. 3, but showing the laptop and the laptop carrier in another using aspect.

Referring to FIG. 3, the strap 220 is hung around the shoulder(s) when the laptop 300 is not in use. Referring to FIG. 4, the following steps are performed to stably support the electronic device 300 by the laptop carrier 200 when the laptop 300 is to be used. First, the strap 220 of the laptop carrier 200 is hung around the neck. Then, the first shell 212 and the second shell 214 are unfolded at an angle, while the clipping members 230 are engaged in the slots 215 of the second shell 214, therefore the unfolded second shell 214 can stably lean against the body e.g., the chest, the abdomen or other position as in conventional usage. The hinge 216 of the case portion 210 can hold the first shell 212 stably relative to the second shell 214, thus, the positioning (angle) of the first shell 212 relative to user's body is stable and the laptop 300 can be stably supported on the upper sheet 212*a* of the first 212 for operation. It should be noted that the operating procedure mentioned above is just an exemplary example to clearly describe a using method of the laptop carrier 200, and should not be considered as a restriction or limit for present invention.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A laptop carrier comprising:

a case portion comprising a first shell and a second shell rotatably connected to each other at respective first ends thereof by a hinge and releasably latched to each other at respective second ends thereof by a latching member;

a strap having a first terminal end and a second terminal end; and a pair of clipping members located between the terminal ends;

such that in a first position of the laptop, the strap is attached to the case portion adjacent the first ends of the shells by only the terminal ends thereof;

and such that in a second position of the laptop, the clipping members of the strap are also attached to the case portion adjacent the second ends of the shells.

2. The laptop carrier in claim 1, wherein the first shell comprises an upper sheet and four upper side walls perpendicularly extending from a periphery of the upper sheet; and the second shell comprises a lower sheet and four lower side walls perpendicularly extending from a periphery of the lower sheet.

3. The laptop carrier in claim 2, wherein the hinge comprises a sleeve attached on an edge of the first shell and a pivot shaft attached on the second shell; and the pivot shaft is frictionally sleeved in the sleeve.

4. The laptop carrier in claim 3, wherein the case portion further comprises a pair of slots defined on the upper or lower side walls corresponding to the clipping members; and the slots are configured for receiving the clipping members.

5. The laptop carrier in claim 4, wherein the slots are defined on a pair of opposite upper side walls or two opposite lower side walls; and the pivot shaft is attached on a position of the upper or lower shells where is adjacent to one of those walls without the slot.

6. The laptop carrier in claim 4, wherein each of the slots comprises a wider portion and a narrow portion communicating with the wider portion.

7. The laptop carrier in claim 6, wherein the clipping members are separately attached on the strap corresponding to the slots and capable of inserting into the corresponding slots.

8. The laptop carrier in claim 7, wherein each of the clipping members comprises a bushing sleeved on the strap, a connecting portion protruding from the bushing, and a plug supported by the connecting portion.

9. The laptop carrier in claim 8, wherein a width of the plug is smaller than that of the wider portion and bigger than that of the narrow portion of the slot; and a width of the connecting portion is smaller than that of the narrow portion.

10. The laptop carrier in claim 2, wherein the latching member comprises a fastener and a flap; an end of the flap is attached on one of the first or second shells, and the other end of the flap is detachably attached on the other one of the respective first or second shells by the fastener.

11. The laptop carrier in claim 10, wherein the fastener is made of a couple of magnets.

* * * * *